US011004375B2

(12) United States Patent
Xu et al.

(10) Patent No.: US 11,004,375 B2
(45) Date of Patent: May 11, 2021

(54) SIGNAL PROTECTION CIRCUIT, DRIVING METHOD THEREOF, AND DEVICE

(71) Applicants: Fuzhou BOE Optoelectronics Technology Co., Ltd., Fujian (CN); BOE Technology Group Co., Ltd., Beijing (CN)

(72) Inventors: Weize Xu, Beijing (CN); Yichiang Lai, Beijing (CN); Zuwei Weng, Beijing (CN); Bin Weng, Beijing (CN); Jiujian Han, Beijing (CN); Qianglong Li, Beijing (CN); Nani Liu, Beijing (CN); Yupeng Huang, Beijing (CN)

(73) Assignees: Fuzhou BOE Optoelectronics Technology Co., Ltd., Fujian (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/639,819

(22) PCT Filed: Jan. 3, 2019

(86) PCT No.: PCT/CN2019/070252
§ 371 (c)(1),
(2) Date: Feb. 18, 2020

(87) PCT Pub. No.: WO2020/140236
PCT Pub. Date: Jul. 9, 2020

(65) Prior Publication Data

US 2020/0357319 A1 Nov. 12, 2020

(51) Int. Cl.
*G09G 3/20* (2006.01)

(52) U.S. Cl.
CPC ..... *G09G 3/20* (2013.01); *G09G 2330/028* (2013.01); *G09G 2330/04* (2013.01)

(58) Field of Classification Search
CPC .. G09G 3/006; G09G 3/20; G09G 2300/0408; G09G 2310/0267;
(Continued)

(56) References Cited

U.S. PATENT DOCUMENTS

2011/0084675 A1* 4/2011 Kawagoshi ..... H02M 3/07 323/282
2016/0191043 A1* 6/2016 Huang ..... H02M 3/07 327/536
2018/0014371 A1 1/2018 Wey

FOREIGN PATENT DOCUMENTS

CN 102279303 A 12/2011
CN 104615183 A 5/2015
CN 108766381 A 11/2018

* cited by examiner

*Primary Examiner* — Nelson M Rosario
(74) *Attorney, Agent, or Firm* — Arent Fox LLP; Michael Fainberg

(57) ABSTRACT

A signal protection circuit, a driving method thereof, and a device. A voltage division circuit divides a voltage of an input signal end and outputs a divided voltage. When the divided voltage is greater than a first threshold voltage and the divided voltage is less than a second threshold voltage, a signal control circuit outputs a first-level switch control signal. In this way, an output control circuit can connect the input signal end with an output signal end in response to the first-level switch control signal. When the divided voltage is less than the first threshold voltage or the divided voltage is greater than the second threshold voltage, the signal control circuit may output a second-level switch control signal. In this way, the output control circuit can connect the input signal end with a ground terminal in response to the second-level switch control signal.

19 Claims, 4 Drawing Sheets

(58) Field of Classification Search
CPC ..... G09G 2310/0286; G09G 2330/028; G09G 2330/04; G09G 2330/12; H02M 3/07; H03K 5/24
See application file for complete search history.

SIGNAL PROTECTION CIRCUIT, DRIVING METHOD THEREOF, AND DEVICE

CROSS-REFERENCE TO RELATED APPLICATION

This application is a National Stage of International Application No. PCT/CN2019/070252, filed Jan. 3, 2019, which is hereby incorporated by reference in its entirety.

FIELD

The present disclosure relates to the technical field of circuits, in particular to a signal protection circuit and a driving method thereof, a signal processing chip, a display panel, and an electronic device.

BACKGROUND

With continuous development of a display technology, display panels are applied in various electronic devices, such as mobile phones, televisions, tablets and displays. Generally, the display panels need voltage input to perform display work.

SUMMARY

An embodiment of the present disclosure provides a signal protection circuit, including:

a voltage division circuit, configured to divide a voltage of an input signal end and output a divided voltage;

a signal control circuit, configured to receive the divided voltage, and output a first-level switch control signal when the divided voltage is greater than a first threshold voltage and the divided voltage is less than a second threshold voltage; and output a second-level switch control signal when the divided voltage is less than the first threshold voltage or the divided voltage is greater than the second threshold voltage, wherein the first threshold voltage is less than the second threshold voltage; and an output control circuit, configured to connect the input signal end with an output signal end in response to the first-level switch control signal; and connect the input signal end with a ground terminal in response to the second-level switch control signal.

Optionally, in the embodiment of the present disclosure, the signal control circuit includes: a first resistor, a second resistor, a first comparator, and a second comparator;

an inverting input end of the first comparator is configured to receive the divided voltage, a non-inverting input end of the first comparator is configured to receive the first threshold voltage, and an output end of the first comparator is coupled to the output control circuit, and is configured to output the switch control signals;

a non-inverting input end of the second comparator is configured to receive the divided voltage, an inverting input end of the second comparator is configured to receive the second threshold voltage, and an output end of the second comparator is coupled to the output control circuit, and is configured to output the switch control signals;

a first end of the first resistor is coupled to the non-inverting input end of the first comparator, and a second end of the first resistor is coupled to the ground terminal; and a first end of the second resistor is coupled to the inverting input end of the second comparator, and a second end of the second resistor is coupled to the ground terminal.

Optionally, in the embodiment of the present disclosure, the signal control circuit further includes: a first current source, a second current source, a third resistor, a fourth resistor, a fifth resistor, and a sixth resistor;

a current output end of the first current source is coupled to a first end of the third resistor, and a second end of the third resistor is separately coupled to the non-inverting input end of the first comparator and the first end of the first resistor, and is configured to output the first threshold voltage to the non-inverting input end of the first comparator;

a current output end of the second current source is coupled to a first end of the fourth resistor, and a second end of the fourth resistor is coupled to the inverting input end of the second comparator and the first end of the second resistor, and is configured to output the second threshold voltage to the inverting input end of the second comparator;

a first end of the fifth resistor is coupled to a reference voltage terminal, and a second end of the fifth resistor is coupled to the output end of the first comparator; and both the output end of the first comparator and the output end of the second comparator are coupled to the output control circuit by the sixth resistor, and are configured to output the switch control signals.

Optionally, in the embodiment of the present disclosure, the output control circuit is configured to connect the input signal end with the output signal end by the voltage division circuit in response to the first-level switch control signal; and connect the input signal end with the ground terminal by the voltage division circuit in response to the second-level switch control signal.

Optionally, in the embodiment of the present disclosure, the voltage division circuit includes a seventh resistor and an eighth resistor;

a first end of the seventh resistor is coupled to the input signal end, and a second end of the seventh resistor is separately coupled to a first end of the eighth resistor and the signal control circuit, and is configured to output the divided voltage; and a second end of the eighth resistor is coupled to the output control circuit.

Optionally, in the embodiment of the present disclosure, the output control circuit includes a two-channel selection switch; and a control end of the two-channel selection switch is coupled to the signal control circuit, and is configured to receive the switch control signals, an input end of the two-channel selection switch is coupled to the voltage division circuit, a first output end of the two-channel selection switch is coupled to the output signal end, and a second output end of the two-channel selection switch is coupled to the ground terminal.

Optionally, in this embodiment of the present disclosure, the output control circuit further includes: a ninth resistor, a tenth resistor, and a switch transistor, wherein the second output end of the two-channel selection switch is coupled to the ground terminal by the ninth resistor, the tenth resistor, and the switch transistor;

a first end of the ninth resistor is coupled to the second output end of the two-channel selection switch, and a second end of the ninth resistor is coupled to a first pole of the switch transistor;

a gate of the switch transistor is coupled to the signal control circuit, and is configured to receive the switch control signals, and a second pole of the switch transistor is coupled to a first end of the tenth resistor; and a second end of the tenth resistor is coupled to the ground terminal.

Correspondingly, an embodiment of the present disclosure further provides a signal processing chip, including: a chip main circuit having at least one output end and at least one above signal protection circuit, wherein one signal protection circuit and one output end of the chip main circuit are correspondingly disposed; and an input signal end of the signal protection circuit is coupled to a corresponding output end of the chip main circuit, and an output signal end of the signal protection circuit is used as a new output end of corresponding chip main circuit.

Optionally, in the embodiment of the present disclosure, the signal processing chip includes a level conversion chip.

Optionally, in the embodiment of the present disclosure, the output ends of the chip main circuit are correspondingly disposed with the signal protection circuits in an one-to-one manner.

Correspondingly, an embodiment of the present disclosure further provides a display panel, including the above signal protection circuit.

Optionally, in the embodiment of the present disclosure, the display panel includes:

a gate driving circuit;

a plurality of cables, configured to input signals to the gate driving circuit;

a plurality of signal input terminals, wherein one signal input terminal is correspondingly coupled to one cable;

at least one signal protection circuit, wherein one signal protection circuit corresponds to one signal input terminal; and an input signal end of the signal protection circuit is coupled to the corresponding signal input terminal, and an output signal end of the signal protection circuit is coupled to the corresponding cable.

Optionally, in the embodiment of the present disclosure, the signal input terminals are correspondingly disposed with the signal protection circuits in an one-to-one manner.

Correspondingly, an embodiment of the present disclosure further provides an electronic device, including the above signal processing chip and/or the above display panel.

Correspondingly, an embodiment of the present disclosure further provides a driving method of the above signal protection circuit, including:

dividing, by the voltage division circuit, a voltage of an input signal end and outputting a divided voltage;

outputting, by the signal control circuit, a first-level switch control signal when the divided voltage is greater than a first threshold voltage and the divided voltage is less than a second threshold voltage; and connecting, by the output control circuit the input signal end with an output signal end in response to the first-level switch control signal;

outputting, by the signal control circuit, a second-level switch control signal when the divided voltage is less than the first threshold voltage or the divided voltage is greater than the second threshold voltage; and connecting, by the output control circuit, the input signal end with a ground terminal in response to the second-level switch control signal.

DETAILED DESCRIPTION OF THE EMBODIMENTS

Figure 1:
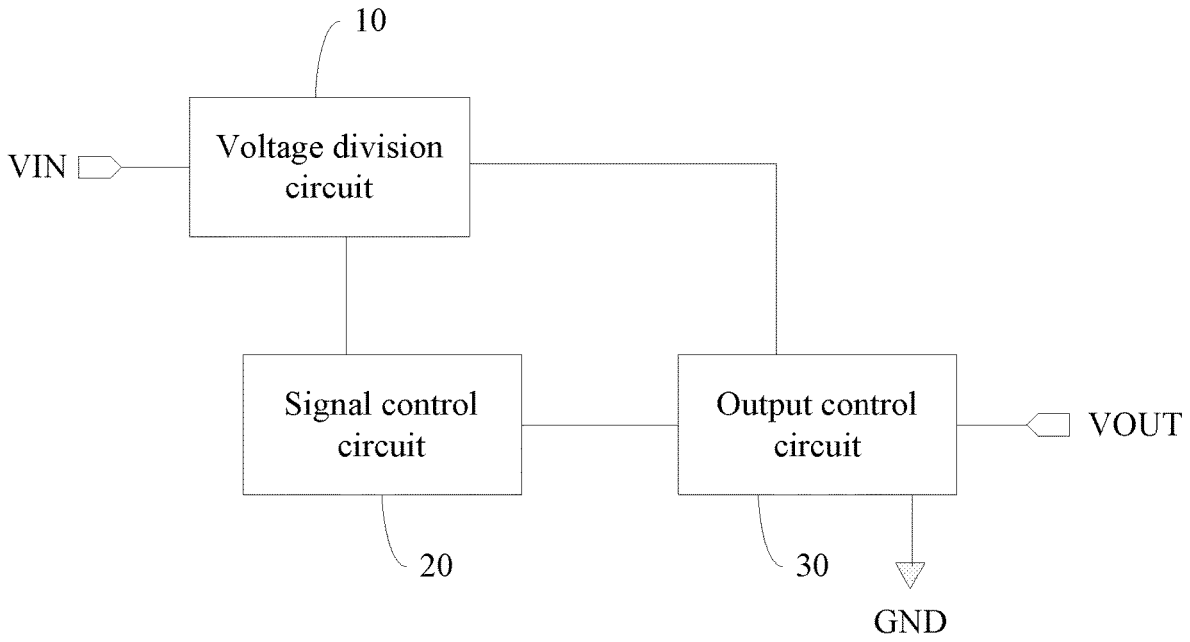
FIG. 1 is a schematic structural diagram of a signal protection circuit according to an embodiment of the present disclosure.

To make the objective, technical solutions and advantages of the present disclosure more clear, specific implementations of a signal protection circuit and a driving method thereof, a signal processing chip, a display panel, and an electronic device provided by embodiments of the present disclosure will be described in detail below with reference to accompanying drawings. It should be understood that the preferred embodiments described below are only used to illustrate and explain the present disclosure, and are not intended to limit the present disclosure. In the case of no conflict, the embodiments in the present disclosure and features in the embodiments can be combined with each other. It should be noted that sizes and shapes of figures in the accompanying drawings do not reflect the true scale, and the purpose is only to illustrate the contents of the present disclosure. The same or similar reference numerals throughout indicate the same or similar elements or elements having the same or similar functions.

With rapid development of a display technology, a trend of display panels increasingly goes towards high integration and low cost. In a Gate Driver on Array (Gate Driver on Array, GOA) technology, a thin film transistor (Thin Film Transistor, TFT) gate driving circuit is integrated on an array substrate of the display panel to form scanning driving for a gate line of the display panel. Signals, such as a clock signal CLK, a frame trigger signal STV, a high voltage signal VGH, and a low voltage signal VGL are required to be inputted to the gate driving circuit, to control the gate driving circuit to output a gate scanning signal to the gate line for scanning driving. Generally, an integrated circuit (Integrated Circuit, IC) disposed on a printed circuit board is configured to input the signals, such as the clock signal CLK, the frame trigger signal STV, the high voltage signal VGH, and the low voltage signal VGL to the gate driving circuit.

However, during use, a current corresponding to a voltage inputted to the display panel may change. As a result, the display panel displays abnormally or even is damaged. For example, other circuits are also disposed on the printed circuit board; and due to the process and the use process, other circuits disposed on the display panel or the printed circuit board may cause a short circuit or a broken circuit. When the short circuit occurs, a current of an output signal is large, and the excessive current easily causes components in the display panel to be burned. When the broken circuit occurs, the internal resistance increases, and a current of an output signal is small, consequently, a problem that the display panel displays abnormally occurs.

Based on this, an embodiment of the present disclosure provides a signal protection circuit. As shown in FIG. 1, the signal protection circuit may include: a voltage division circuit 10, a signal control circuit 20, and an output control circuit 30.

The voltage division circuit 10 is configured to divide a voltage of an input signal end VIN and output a divided voltage.

The signal control circuit 20 is configured to: receive the divided voltage, and output a first-level switch control signal when the divided voltage is greater than a first threshold voltage and the divided voltage is less than a second threshold voltage; output a second-level switch control signal when the divided voltage is less than the first threshold voltage; and also output a second-level switch control signal when the divided voltage is greater than the second threshold voltage. The first threshold voltage is less than the second threshold voltage.

The output control circuit 30 is configured to: receive the first-level switch control signal and the second-level switch control signal, and connect the input signal end VIN with an output signal end VOUT in response to the first-level switch control signal; and connect the input signal end VIN with a ground terminal GND in response to the second-level switch control signal.

In the above signal protection circuit provided by the embodiment of the present disclosure, the voltage division circuit divides the voltage of the input signal end and outputs the divided voltage. The signal control circuit outputs the first-level switch control signal when the divided voltage is greater than the first threshold voltage and the divided voltage is less than the second threshold voltage. In this way, the output control circuit may connect the input signal end with the output signal end in response to the first-level switch control signal. That is, when the divided voltage meets a range defined by the first threshold voltage and the second threshold voltage, it can be explained that the change in the voltage of the input signal end is within an acceptable change range, so that the voltage of the input signal end can be outputted. The signal control circuit may output the second-level switch control signal when the divided voltage is less than the first threshold voltage or the divided voltage is greater than the second threshold voltage. In this way, the output control circuit may connect the input signal end with the output signal end in response to the second-level switch control signal. That is, when the divided voltage does not meet the range defined by the first threshold voltage and the second threshold voltage, it can be explained that the change in the voltage of the input signal end is not within the acceptable change range, so that the voltage of the input signal end cannot be outputted, and discharge needs to be performed. In this way, the signal protection circuit provided in the embodiment of the present disclosure can be disposed on a path between an output end of an IC and a component receiving end of a display panel, so that stability can be improved, and a problem that the display panel displays abnormally due to a broken circuit or a broken circuit on other circuits disposed on the display panel or a printed circuit board can be avoided.

The present disclosure is described in detail below with reference to specific embodiments. It should be noted that this embodiment is to better explain the present disclosure, but not to limit the present disclosure.

In specific implementation, in the embodiment of the present disclosure, as shown in FIG. 1, the output control circuit 30 may be specifically configured to connect the input signal end VIN with the output signal end VOUT by the voltage division circuit 10 in response to the first-level switch control signal; and connect the input signal end VIN with the ground terminal GND conductive by the voltage division circuit 10 in response to the second-level switch control signal. In this way, stability can be further improved.

Figure 2:
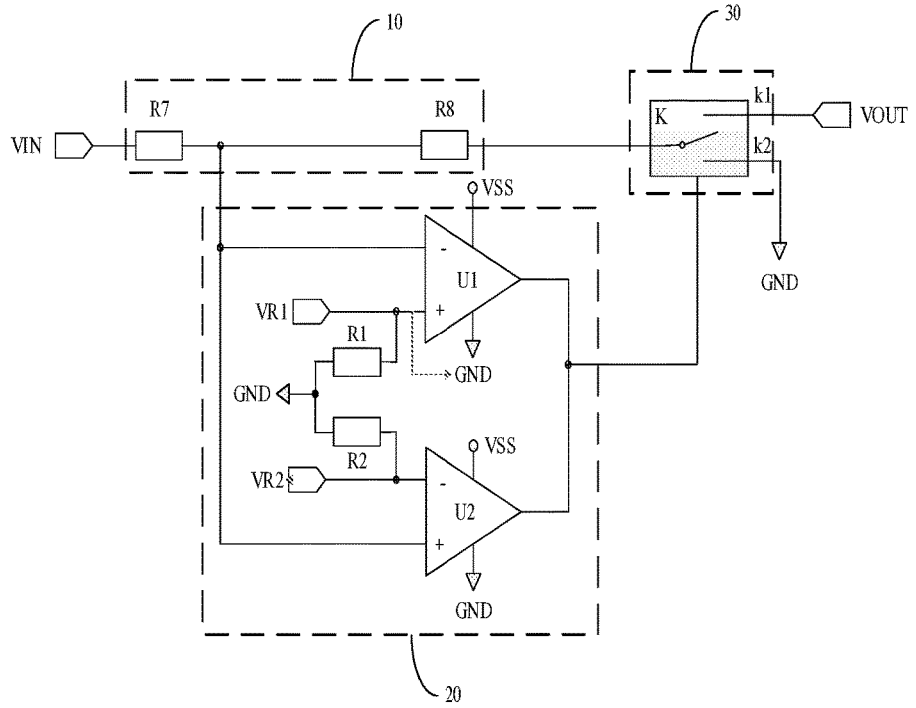
FIG. 2 is a first schematic diagram of a specific structure of a signal protection circuit according to an embodiment of the present disclosure.

A schematic structural diagram of a signal protection circuit corresponding to some embodiments of the present disclosure is shown in FIG. 2. In specific implementation, the above signal protection circuit provided by the embodiments of the present disclosure can be applied to devices such as an IC and a display panel to improve stability. In practical application, different devices have different requirements for stability. Therefore, the first threshold voltage and the second threshold voltage can be designed and determined according to an actual application environment, and are not limited herein. For example, voltage values of the first threshold voltage and the second threshold voltage corresponding to display panels of different sizes, different architectures, and different resolutions may be different. Therefore, the first threshold voltage and the second threshold voltage can be designed and determined according to actual needs of the display panels.

In specific implementation, in the embodiment of the present disclosure, as shown in FIG. 2, the voltage division circuit 10 may include a seventh resistor R7 and an eighth resistor R8.

A first end of the seventh resistor R7 is coupled to the input signal end VIN, and a second end of the seventh resistor R7 is separately coupled to a first end of the eighth resistor R8 and the signal control circuit 20, and is configured to output the divided voltage.

A second end of the eighth resistor R8 is coupled to the output control circuit 30.

In specific implementation, in the embodiment of the present disclosure, resistance values of the seventh resistor R7 and the eighth resistor R8 may be the same, or may be different. Certainly, because different devices have different requirements for stability, the resistance values of the seventh resistor R7 and the eighth resistor R8 can be designed and determined according to an actual application environment, and are not limited herein.

In specific implementation, in the embodiment of the present disclosure, as shown in FIG. 2, the output control circuit 30 may include a two-channel selection switch K. A control end of the two-channel selection switch K is coupled to the signal control circuit 20, and is configured to receive the switch control signal. An input end of the two-channel selection switch K is coupled to the voltage division circuit 10, a first output end k1 of the two-channel selection switch K is coupled to the output signal end VOUT, and a second output end k2 of the two-channel selection switch K is coupled to the ground terminal GND. Specifically, the input end of the two-channel selection switch K is coupled to the second end of the eighth resistor R8 in the voltage division circuit 10.

In specific implementation, in the embodiment of the present disclosure, the two-channel selection switch K may connect the second end of the eighth resistor R8 with the output signal end VOUT in response to the first-level switch control signal, to output the voltage of the input signal end VIN. The two-channel selection switch K may connect the second end of the eighth resistor R8 with the ground terminal GND in response to the second-level switch control signal to discharge the voltage of the input signal end VIN. The structure and principle of the two-channel selection switch K may be basically the same as the structure and principle of a comparator in the related art. Details are not described herein.

In specific implementation, in the embodiment of the present disclosure, as shown in FIG. 2, the signal control circuit 20 may include a first resistor R1, a second resistor R2, a first comparator U1, and a second comparator U2.

An inverting input end of the first comparator U1 is configured to receive the divided voltage. A non-inverting input end of the first comparator U1 is configured to receive the first threshold voltage VR1. An output end of the first comparator U1 is coupled to the output control circuit 30, and is configured to output the switch control signal. Specifically, the inverting input end of the first comparator U1 is coupled to the second end of the seventh resistor R7 in the voltage division circuit 10.

A non-inverting input end of the second comparator U2 is configured to receive the divided voltage. An inverting input end of the second comparator U2 is configured to receive the second threshold voltage VR2. An output end of the second comparator U2 is coupled to the output control circuit 30, and is configured to output the switch control signal. Specifically, the non-inverting input end of the second comparator U2 is coupled to the second end of the seventh resistor R7 in the voltage division circuit 10.

A first end of the first resistor R1 is coupled to the non-inverting input end of the first comparator U1, and a second end of the first resistor R1 is coupled to the ground terminal GND.

A first end of the second resistor R2 is coupled to the inverting input end of the second comparator U2, and a second end of the second resistor R2 is coupled to the ground terminal GND.

Generally, when a voltage of a non-inverting input end of a comparator is higher than a voltage of an inverting input end of the comparator, an output end of the comparator can output a high-level signal. When a voltage of a non-inverting input end of a comparator is lower than a voltage of an inverting input end of the comparator, an output end of the comparator can output a low-level signal. In specific implementation, in the embodiment of the present disclosure, when a voltage of the non-inverting input end of the first comparator U1 is higher than a voltage of the inverting input end of the first comparator U1, the output end of the first comparator U1 can output a high-level signal. When a voltage of the non-inverting input end of the first comparator U1 is lower than a voltage of the inverting input end of the first comparator U1, the output end of the first comparator U1 can output a low-level signal. When a voltage of the non-inverting input end of the second comparator U2 is higher than a voltage of the inverting input end of the second comparator U2, the output end of the second comparator U2 can output a high-level signal. When a voltage of the non-inverting input end of the second comparator U2 is lower than a voltage of the inverting input end of the second comparator U2, the output end of the second comparator U2 can output a low-level signal. Therefore, in specific implementation, the first level may be a low level and the second level may be a high level. Further, the first comparator U1 and the second comparator U2 are further coupled to a reference signal terminal VSS and the ground terminal GND. Certainly, in practical application, structures and principles of the first comparator U1 and the second comparator U2 may be basically the same as structures and principles of comparators in the related art. Details are not described herein.

In specific implementation, in the embodiment of the present disclosure, because the first threshold voltage is different from the second threshold voltage, the resistance value of the first resistor R1 is different from that of the second resistor R2. Certainly, in practical application, the resistance values of the first resistor R1 and the second resistor R2 may be designed and determined according to the first threshold voltage and the second threshold voltage. This is not limited herein.

The above description is only an example to illustrate the specific structures of the circuits in the signal protection circuit provided by the embodiment of the present disclosure. In specific implementation, the specific structures of the above circuits are not limited to the above structures provided by the embodiment of the present disclosure, and may also be other structures that can be known by person skilled in the art. This is not limited here.

Figure 3:
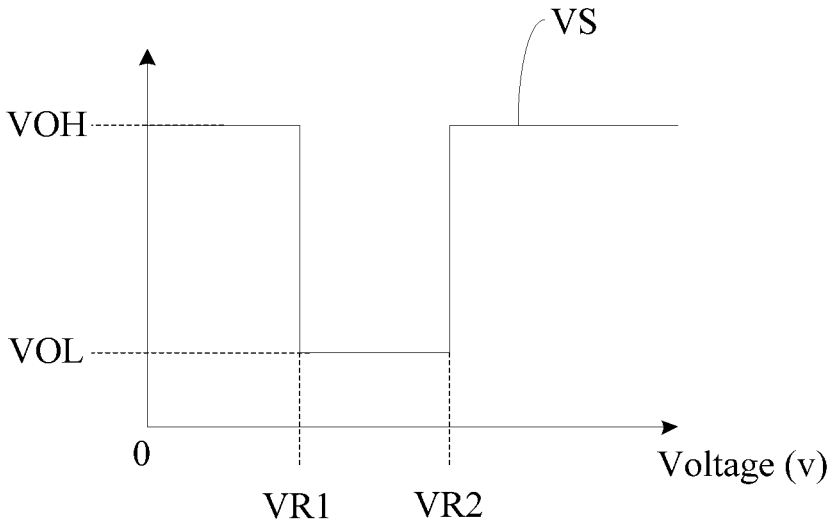
FIG. 3 is a schematic diagram of a switch control signal in an embodiment of the present disclosure.

The structure shown in FIG. 2 is used as an example below, and a working process of the signal protection circuit provided by the embodiment of the present disclosure is described with reference to a signal timing diagram shown in FIG. 3. As shown in FIG. 3, a horizontal coordinate represents a voltage, and a vertical coordinate represents a level.

A voltage of the input signal end VIN can be divided by the seventh resistor R7 and the eighth resistor R8, and the divided voltage VF can be outputted from the second end of the seventh resistor R7. When the divided voltage VF is greater than the first threshold voltage VR1, the output end of the first comparator U1 may output a low-level signal. When the divided voltage VF is less than the second threshold voltage VR2, the output end of the second comparator U2 may output a low-level signal. Therefore, when the divided voltage VF is greater than the first threshold voltage VR1 and the divided voltage VF is less than the second threshold voltage VR2, it can be explained that there is a small change fluctuation in the voltage of the input signal end VIN. In this way, a low-level VOL switch control signal VS is outputted to the control end of the two-channel selection switch K by using the signal control circuit 20, to control the two-channel selection switch K to make the second end of the eighth resistor R8 and the output signal end VOUT conductive, so that the voltage of the input signal end VIN is outputted.

When the divided voltage VF is less than the first threshold voltage VR1, the output end of the first comparator U1 can output the high-level signal. Because the first threshold voltage VR1 is less than the second threshold voltage VR2, the divided voltage VF is also less than the second threshold voltage VR2, and the output end of the second comparator U2 can output the low-level signal. Therefore, when the divided voltage VF is less than the first threshold voltage VR1, it can be explained that the voltage of the input signal end VIN is reduced. In addition, because the output end of the first comparator U1 can output the high-level signal, the level of the switch control signal VS can be pulled high. In this way, a high-level VOH switch control signal VS is outputted to the control end of the two-channel selection switch K by using the signal control circuit 20, to control the two-channel selection switch K to make the second end of the eighth resistor R8 and the ground terminal GND conductive, so that the voltage of the input signal end VIN is discharged, and the voltage of the input signal end VIN is not outputted.

When the divided voltage VF is greater than the second threshold voltage VR2, the output end of the second comparator U2 may output the high-level signal. Because the first threshold voltage VR1 is less than the second threshold voltage VR2, the divided voltage VF is also greater than the first threshold voltage VR1, and the output end of the first comparator U1 can output the low-level signal. Therefore, when the divided voltage VF is greater than the second threshold voltage VR2, it can be explained that the voltage of the input signal end VIN is increased. In addition, because the output end of the second comparator U2 can output the high-level signal, the level of the switch control signal VS can be pulled high. In this way, the high-level VOH switch control signal VS is outputted to the control end of the two-channel selection switch K by using the signal control circuit 20, to control the two-channel selection switch K to make the second end of the eighth resistor R8 and the ground terminal GND conductive, so that the voltage of the input signal end VIN is discharged, and the voltage of the input signal end VIN is not outputted.

Figure 4:
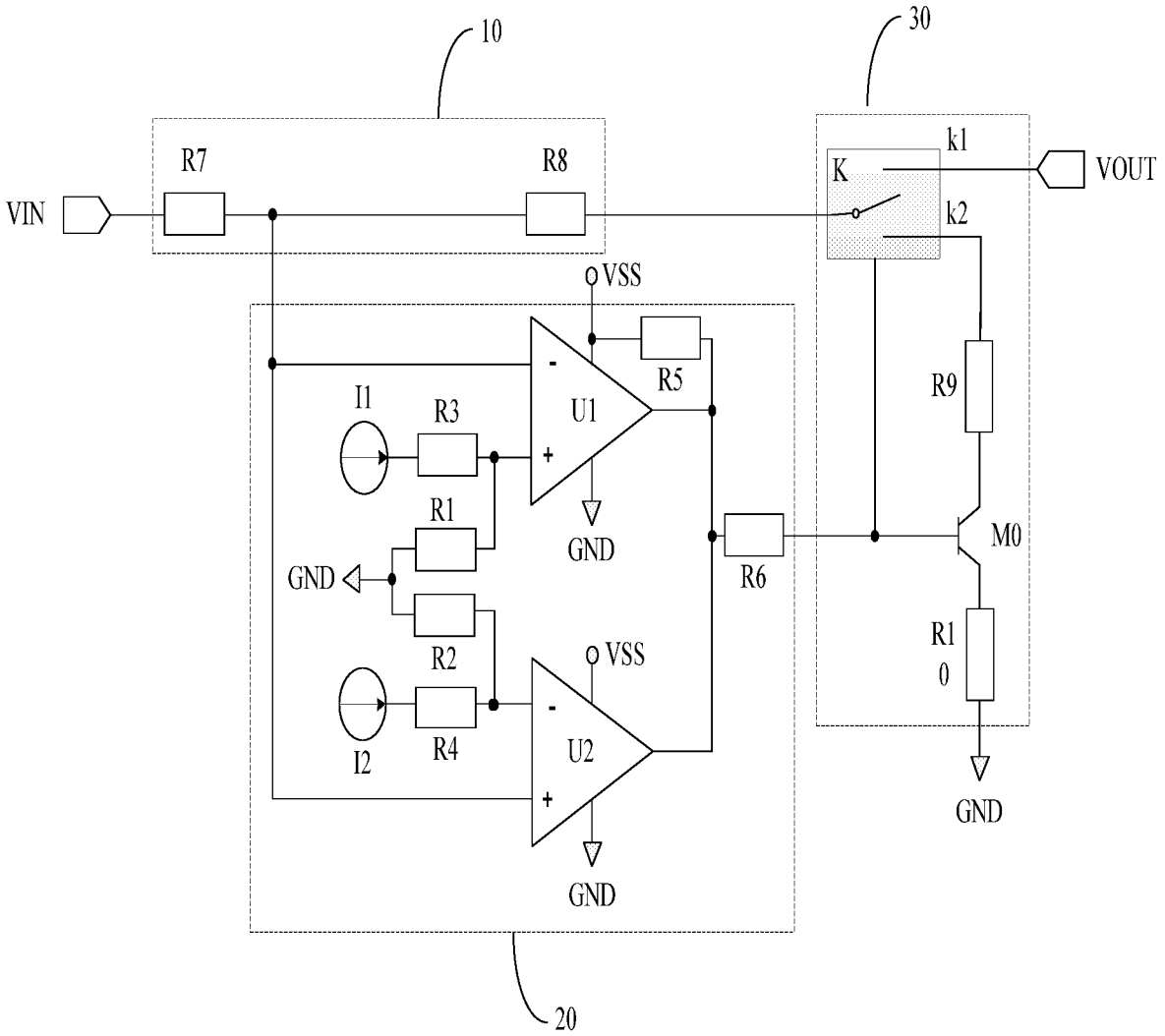
FIG. 4 is a second schematic diagram of a specific structure of a signal protection circuit according to an embodiment of the present disclosure.

A schematic structural diagram of a signal protection circuit corresponding to another embodiment of the present disclosure is shown in FIG. 4, and is a modification of the implementation of some structures in FIG. 2. Only differences between this embodiment and the embodiment shown in FIG. 2 will be described below, and the same points will not be repeated herein.

In specific implementation, in the embodiment of the present disclosure, as shown in FIG. 4, the signal control circuit 20 may further include a first current source I1, a second current source I2, a third resistor R3, a fourth resistor R4, a fifth resistor R5, and a sixth resistor R6.

A current output end of the first current source I1 is coupled to a first end of the third resistor R3, and a second end of the third resistor R3 is separately coupled to the non-inverting input end of the first comparator U1 and a first end of the first resistor R1, to output the first threshold voltage to the non-inverting input end of the first comparator U1. Specifically, a voltage of the second end of the third resistor R3 can form the first threshold voltage VR1 by using a voltage dividing effect of the third resistor R3 and the first resistor R1.

A current output end of the second current source I2 is coupled to a first end of the fourth resistor R4. A second end of the fourth resistor R4 is separately coupled to the inverting input end of the second comparator U2 and a first end of the second resistor R2, to output the second threshold voltage to the inverting input end of the second comparator U2. Specifically, a voltage of the second end of the fourth resistor R4 can form the second threshold voltage VR2 by using a voltage dividing effect of the fourth resistor R4 and the second resistor R2.

A first end of the fifth resistor R5 is coupled to a reference voltage terminal VSS, and a second end of the fifth resistor R5 is coupled to the output end of the first comparator U1.

Both the output end of the first comparator U1 and the output end of the second comparator U2 are coupled to the output control circuit 30 by using the sixth resistor R6, and are configured to output a switch control signal. Specifically, both the output end of the first comparator U1 and the output end of the second comparator U2 are coupled to the control end of the two-channel selection switch K in the output control circuit 30 by using the sixth resistor R6.

In specific implementation, in the embodiment of the present disclosure, the first current source I1 can output a current i1. In practical application, it can be designed and determined according to an actual application environment. This is not limited herein.

In specific implementation, in the embodiment of the present disclosure, the second current source I2 may output a current i2. In practical application, i2 can be designed and determined according to an actual application environment. This is not limited herein.

In specific implementation, in the embodiment of the present disclosure, as shown in FIG. 4, the output control circuit 30 may further include a ninth resistor R9, a tenth resistor R10, and a switch transistor M0. A second output end k2 of the two-channel selection switch K is coupled to the ground terminal GND by using the ninth resistor R9, the tenth resistor R10, and the switch transistor M0.

A first end of the ninth resistor R9 is coupled to the second output end k2 of the two-channel selection switch K. A second end of the ninth resistor R9 is coupled to a first pole of the switch transistor M0.

A gate of the switch transistor M0 is coupled to the signal control circuit 20, and is configured to receive the switch control signal. A second pole of the switch transistor M0 is coupled to a first end of the tenth resistor R10.

A second end of the tenth resistor R10 is coupled to the ground terminal GND.

In specific implementation, the switch transistor M0 may be an N-type transistor or a P-type transistor. In the embodiment of the present disclosure, the switch transistor M0 may be a transistor, a thin film transistor (Thin Film Transistor, TFT), or a metal oxide semiconductor field effect transistor (Metal Oxide Semiconductor Field-Effect Transistor, MOSFET). This is not limited herein. According to differences between the type of the switch transistor and the level of the switch control signal, the first pole can be used as a source or a drain, and the second pole can be used as the drain or the source. This is not limited herein.

The structure shown in FIG. 4 is used as an example below, and a working process of the signal protection circuit provided by the embodiment of the present disclosure is described with reference to the signal timing diagram shown in FIG. 3.

A voltage of the input signal end VIN can be divided by the seventh resistor R7 and the eighth resistor R8, and the divided voltage VF can be outputted from the second end of the seventh resistor R7. When the divided voltage VF is greater than the first threshold voltage VR1, the output end of the first comparator U1 may output a low-level signal. When the divided voltage VF is less than the second threshold voltage VR2, the output end of the second comparator U2 may output a low-level signal. Therefore, when the divided voltage VF is greater than the first threshold voltage VR1 and the divided voltage VF is less than the second threshold voltage VR2, it can be explained that is a small change fluctuation in the voltage of the input signal end VIN. In this way, a low-level VOL switch control signal VS is outputted to the control end of the two-channel selection switch K by using the signal control circuit 20, to control the two-channel selection switch K to make the second end of the eighth resistor R8 and the output signal end VOUT conductive, so that the voltage of the input signal end VIN is outputted. In addition, the low-level VOL switch control signal VS also controls the switch transistor to be cut off.

When the divided voltage VF is less than the first threshold voltage VR1, the output end of the first comparator U1 can output a high-level signal. Because the first threshold voltage VR1 is less than the second threshold voltage VR2, the divided voltage VF is also less than the second threshold voltage VR2, and the output end of the second comparator U2 can output a low-level signal. Therefore, when the divided voltage VF is less than the first threshold voltage VR1, it can be explained that the voltage of the input signal end VIN is reduced. In addition, because the output end of the first comparator U1 can output a high-level signal, the level of the switch control signal VS can be pulled high. In this way, a high-level VOH switch control signal VS is outputted to the control tend of the two-channel selection switch K by using the signal control circuit 20, to control the two-channel selection switch K to make the second end of the eighth resistor R8 and a second output end k2 conductive. In addition, the high-level VOH switch control signal VS also controls the switch transistor to be conductive, so that the two-channel selection switch K makes the second end of the eighth resistor R8 and the ground terminal GND conductive by using the ninth resistor R9, the tenth resistor R10, and the switch transistor M0. In this way, the voltage of the input signal end VIN is discharged and the voltage of the input signal end VIN is not outputted.

When the divided voltage VF is greater than the second threshold voltage VR2, the output end of the second comparator U2 may output a high-level signal. Because the first threshold voltage VR1 is less than the second threshold voltage VR2, the divided voltage VF is also greater than the first threshold voltage VR1, and the output end of the first comparator U1 can output a low-level signal. Therefore, when the divided voltage VF is greater than the second threshold voltage VR2, it can be explained that the voltage of the input signal end VIN is increased. In addition, because the output end of the second comparator U2 can output a high-level signal, the level of the switch control signal VS can be pulled high. In this way, a high-level VOH switch control signal VS can be outputted to the control end of the two-channel selection switch K by using the signal control circuit 20, to control the two-channel selection switch K to make the second end of the eighth resistor R8 and the second output end k2 conductive. In addition, the high-level VOH switch control signal VS also controls the switch transistor to be conductive, so that the two-channel selection switch K makes the second end of the eighth resistor R8 and the ground terminal GND conductive by using the ninth resistor R9, the tenth resistor R10, and the switch transistor M0. In this way, the voltage of the input signal end VIN is discharged, and the voltage of the input signal end VIN is not outputted.

Figure 5:
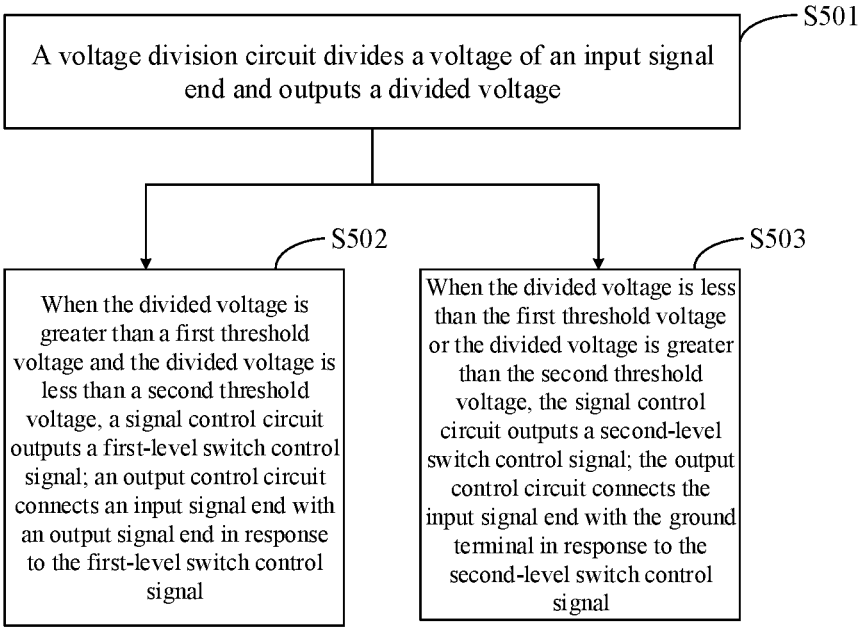
FIG. 5 is a flowchart of a driving method according to an embodiment of the present disclosure.

Based on the same inventive concept, an embodiment of the present disclosure further provides a driving method of the above signal processing chip. As shown in FIG. 5, the method may include the following steps:

S501. A voltage division circuit divides a voltage of an input signal end and outputs a divided voltage;

S502. When the divided voltage is greater than a first threshold voltage and the divided voltage is less than a second threshold voltage, a signal control circuit outputs a first-level switch control signal; an output control circuit connects the input signal end with an output signal end conductive in response to the first-level switch control signal;

S503. When the divided voltage is less than the first threshold voltage or the divided voltage is greater than the second threshold voltage, the signal control circuit outputs a second-level switch control signal; the output control circuit connects the input signal end with a ground terminal conductive in response to the second-level switch control signal.

In specific implementation, in the embodiment of the present disclosure, the output control circuit responds to the first-level switch control signal, and makes the input signal end and the output signal end conductive by using the voltage division circuit. The output control circuit responds to the second-level switch control signal, and makes the input signal end and the ground terminal conductive by using the voltage division circuit.

The driving principle and specific implementation of the driving method of the signal processing chip are the same as the principle and implementation of the signal processing chip of the above embodiment. Therefore, the driving method of the signal processing chip can be implemented with reference to the specific implementation of the signal processing chip in the above embodiment. Details are not described herein.

Figure 6:
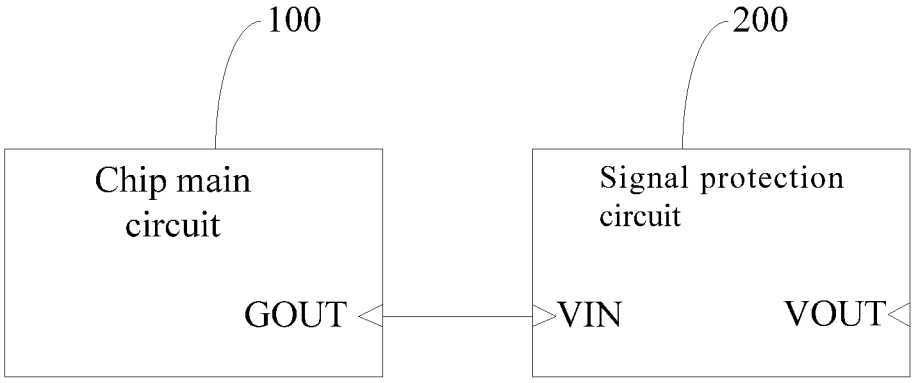
FIG. 6 is a schematic structural diagram of a signal processing chip according to an embodiment of the present disclosure.

Based on the same inventive concept, an embodiment of the present disclosure further provides a signal processing chip. As shown in FIG. 6, the signal processing chip may include: a chip main circuit 100 having at least one output end GOUT and at least one signal protection circuit 200 as described above. One signal protection circuit 200 is correspondingly disposed with one output end GOUT of the chip main circuit 100. In addition, an input signal end VIN of the signal protection circuit 200 is coupled to the corresponding output end GOUT of the chip main circuit 100, and an output signal end VOUT of the signal protection circuit 200 is used as a new output end of corresponding chip main circuit.

Optionally, the signal processing chip outputs a signal to a display panel is used as an example. When the input signal end VIN and an output signal end VOUT of the signal protection circuit 200 are conductive, it can be explained that a voltage of a signal of the output end of the chip main circuit 100 does not change much, that is, it is explained that the display panel or a printed circuit board has no short circuit or broken circuit, so that the signal of the output end of the chip main circuit 100 can be outputted to the display panel by using the signal protection circuit 200, to drive the display panel for displaying or touching. When the input signal end VIN of the signal protection circuit 200 and the ground terminal GND are conductive, it can be explained that the voltage of the signal of the output end of the chip main circuit 100 changes greatly, that is, it is explained that the display panel or the printed circuit board has the short circuit or the broken circuit, so that the signal cannot be outputted to the display panel, and the signal of the output end of the chip main circuit 100 can be discharged by using the ground terminal GND, to ensure that the voltage or current inputted to the display panel is not too large or too small. In addition, the driving principle and specific implementation of the signal protection circuit 200 can be implemented with reference to the specific implementation of the signal protection circuit 200 in the above embodiment. Details are not described herein.

In specific implementation, the signal processing chip may be configured to output signals such as a clock signal CLK, a frame trigger signal STV, a high-voltage signal VGH, and a low-voltage signal VGL to a gate driving circuit in the display panel. For example, the signal processing chip may include a level conversion chip. In specific implementation, the form of combining a software embodiment and a hardware embodiment may be used for the chip main circuit. In addition, the chip main circuit 100 may be basically the same as that in the related art. Details are not described herein.

In specific implementation, when the chip main circuit 100 has a plurality of output ends GOUT, each of some of the output ends GOUT can be correspondingly provided with one signal protection circuit 200. The other output ends GOU are not correspondingly provided with the signal protection circuit 200. For example, when the chip main circuit 100 has six output ends GOUT, each of two, three, or four output ends GOUT can be correspondingly provided with one signal protection circuit 200. The other output ends GOU are not correspondingly provided with the signal protection circuit 200. Further, each output end of the chip main circuit can be correspondingly provided with a signal protection circuit. In this way, stability can be improved by monitoring the voltage of each output end.

Figure 7:
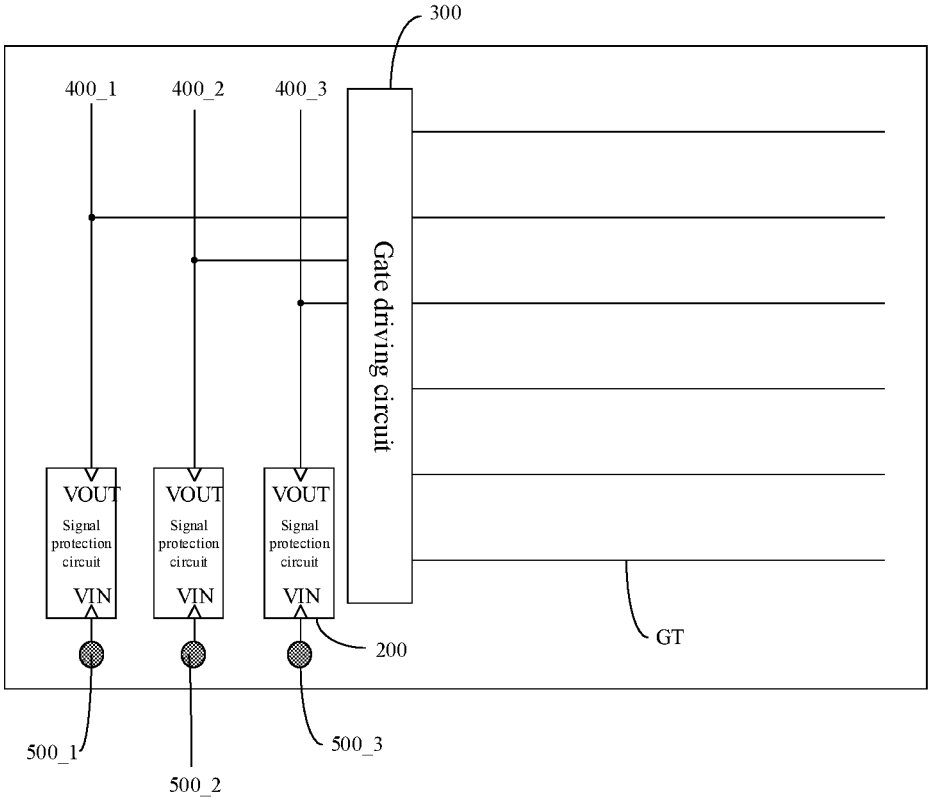
FIG. 7 is a schematic structural diagram of a display panel according to an embodiment of the present disclosure.

Further, in specific implementation, in the embodiment of the present disclosure, as shown in FIG. 7, the display panel may further include a gate line GT coupled to a gate driving circuit 300.

Based on the same inventive concept, an embodiment of the present disclosure further provides a display panel. As shown in FIG. 7, the display panel may include the above signal protection circuit 200. The driving principle and specific implementation of the signal protection circuit 200 can be implemented with reference to the specific implementation of the signal protection circuit 200 in the foregoing embodiment. Details are not described herein.

In specific implementation, in the embodiment of the present disclosure, as shown in FIG. 7, the display panel may include the gate driving circuit 300 and a plurality of cables 400_*m* (m is an integer greater than or equal to 1 and less than or equal to M, where M is the total number of cables, and M=3 is used as an example in FIG. 7) that are configured to input a signal to the gate driving circuit 300, a plurality of signal input terminals 500_*m*, and at least one signal input terminal 500_*m*. One signal input terminal 500_*m* is correspondingly coupled to one cable 400_*m*, and one signal protection circuit 200 corresponds to one signal input terminal. In addition, an input signal end VIN of the signal protection circuit 200 is coupled to the corresponding signal input terminal 500_*m*, and an output signal end VOUT of the signal protection circuit 200 is coupled to the corresponding cable 400_*m*.

Optionally, when the input signal end VIN and the output signal end VOUT of the signal protection circuit 200 are conductive, it can be explained that a voltage of a signal of the coupled signal input terminal does not change much, that is, it is explained that the display panel or a printed circuit board has no short circuit or broken circuit, so that the signal of the signal input terminal can be outputted to the gate driving circuit of the display panel by using the signal protection circuit 200, to drive the display panel for displaying or touching. When the input signal end VIN of the signal protection circuit 200 and a ground terminal GND are conductive, it can be explained that the voltage of the signal of the signal input terminal changes greatly, that is, it is explained that the display panel or the printed circuit board has the short circuit or the broken circuit, so that the signal cannot be outputted to the gate driving circuit of the display panel, and the signal of the signal input terminal can be discharged by using the ground terminal GND, to ensure that the voltage or current inputted to the gate driving circuit is not too large or too small. In addition, the driving principle and specific implementation of the signal protection circuit 200 can be implemented with reference to the specific implementation of the signal protection circuit 200 in the above embodiment. Details are not described herein.

Further, in specific implementation, in the embodiment of the present disclosure, as shown in FIG. 7, each signal input terminal 500_*m* may be respectively provided with one signal protection circuit 200 correspondingly. For example, a signal input terminal 500_1 is correspondingly provided with a signal protection circuit 200, a signal input terminal 500_2 is also correspondingly provided with a signal protection circuit 200, and a signal input terminal 500_3 is also correspondingly provided with a signal protection circuit 200.

In specific implementation, in the embodiments of the present disclosure, M can be set to a value such as 4, 5, 6, or 7. Certainly, a specific value of M can be designed and determined according to a specific application environment. This is not limited herein.

Electroluminescent diodes such as an organic light emitting diode (Organic Light Emitting Diode, OLED), a micro light emitting diode (Micro Light Emitting Diode, Micro-LED), and a quantum dot light emitting diode (Quantum Dot Light Emitting Diode, QLED) have advantages of self-light emission and low energy consumption and the like. In specific implementation, the display panel may be an electroluminescent display panel.

Liquid crystal display (Liquid Crystal Display, LCD) panels have been widely used due to characteristics of light and thin appearance, power saving, no radiation and the like. The working principle of the LCD panels is as follows: An arrangement state of liquid crystal molecules in a liquid crystal layer is changed by changing a voltage difference between two ends of the liquid crystal layer, to change light transmittance of the liquid crystal layer to display an image. In specific implementation, in the embodiment of the present disclosure, the display panel may be a liquid crystal display panel.

Based on the same disclosure concept, an embodiment of the present disclosure further provides an electronic device that may include the above display panel and/or the above signal processing chip provided by the embodiments of the present disclosure. The principle of the electronic device for solving the problem is similar to that of the above display panel and/or the above signal processing chip. Therefore, for implementation of the electronic device, reference may be made to the implementation of the above display panel and/or the above signal processing chip. Details are not repeated herein.

Figure 8:
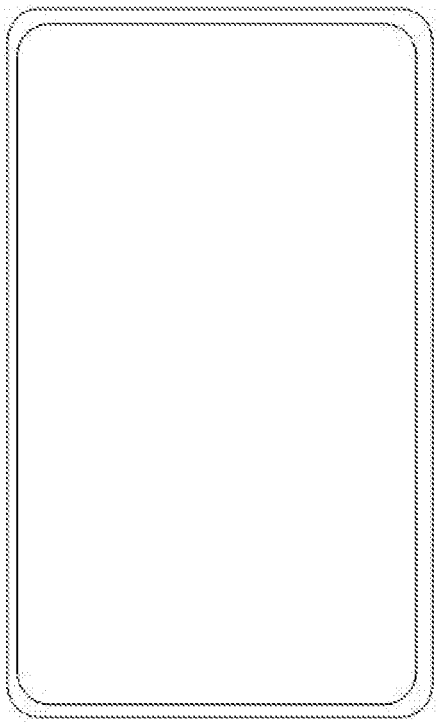
FIG. 8 is a schematic structural diagram of an electronic device according to an embodiment of the present disclosure.

In specific implementation, as shown in FIG. 8, the electronic device provided by the embodiment of the present disclosure may be a mobile phone. Certainly, in specific implementation, the electronic device provided by the embodiment of the present disclosure may further be any product or component having a display function, such as a tablet computer, a television, a display, a notebook computer, a digital photo frame, or a navigator. It should be understood by the person of ordinary skill in the art that the electronic device has other essential components. Details are not described herein. This should not be used as a limitation on the present disclosure.

The embodiments of the present disclosure provide the above signal protection circuit and the driving method thereof, the signal processing chip, the display panel, and the electronic device. A voltage division circuit divides a voltage of an input signal end and outputs a divided voltage. When the divided voltage is greater than a first threshold voltage and the divided voltage is less than a second threshold voltage, a signal control circuit outputs a first-level switch control signal. In this way, an output control circuit can connect the input signal end with an output signal end in response to the first-level switch control signal. That is, when the divided voltage meets a range defined by the first threshold voltage and the second threshold voltage, it can be explained that the change in the voltage of the input signal end is within an acceptable change range, so that the voltage of the input signal end can be outputted. When the divided voltage is less than the first threshold voltage or the divided voltage is greater than the second threshold voltage, the signal control circuit may output a second-level switch control signal. In this way, the output control circuit can connect the input signal end with a ground terminal in response to the second-level switch control signal. That is, when the divided voltage does not meet the range defined by the first threshold voltage and the second threshold voltage, it can be explained that the change in the voltage of the input signal end is not within the acceptable change range, so that the voltage of the input signal end cannot be outputted, and needs to be discharged. In this way, the signal protection circuit provided in the embodiment of the present disclosure can be disposed on a path between an output end of an IC and a component receiving end of a display panel, so that stability can be improved, and a problem that the display panel displays abnormally due to a broken circuit or a broken circuit of the IC can be avoided.

Obviously, the person skilled in the art can make various modifications and variations to the embodiments of the present disclosure without departing from the spirit and scope of the embodiments of the present disclosure. In this way, if these modifications and variations of the embodiments of the present disclosure fall within the scope of the claims of the present disclosure and their equivalent technologies, the present disclosure is also intended to include these changes and variations.

The invention claimed is:

1. A signal protection circuit, comprising: a voltage division circuit, configured to divide a voltage of an input signal end and output a divided voltage; a signal control circuit, configured to receive the divided voltage, and output a first-level switch control signal when the divided voltage is greater than a first threshold voltage and the divided voltage is less than a second threshold voltage; and output a second-level switch control signal when the divided voltage is less than the first threshold voltage or the divided voltage is greater than the second threshold voltage, wherein the first threshold voltage is less than the second threshold voltage; and an output control circuit, configured to connect the input signal end with an output signal end in response to the first-level switch control signal; and connect the input signal end with a ground terminal in response to the second-level switch control signal, wherein the signal control circuit comprises: a first resistor, a second resistor, a first comparator, and a second comparator; an inverting input end of the first comparator is configured to receive the divided voltage, a non-inverting input end of the first comparator is configured to receive the first threshold voltage, and an output end of the first comparator is coupled to the output control circuit, and is configured to output switch control signals; a non-inverting input end of the second comparator is configured to receive the divided voltage, and inverting input end of the second comparator is configured to receive the second threshold voltage, and an output end of the second comparator is coupled to the output control circuit, and is configured to output the switch control signals; a first end of the first resistor is coupled to the non-inverting input end of the first comparator, and a second end of the first resistor is coupled to the ground terminal; and a first end of the second resistor is coupled to the inverting input end of the second comparator, and a second end of the second resistor is coupled to the ground terminal.

2. The signal protection circuit according to claim 1 wherein the signal control circuit further comprises: a first current source, a second current source, a third resistor, a fourth resistor, a fifth resistor, and a sixth resistor; a current output end of the first current source is coupled to a first end of the third resistor, and a second end of the third resistor is coupled to the non-inverting input end of the first comparator and the first end of the first resistor, and is configured to output the first threshold voltage to the non-inverting input end of the first comparator; a current output end of the second current source is coupled to a first end of the fourth resistor, and a second end of the fourth resistor is coupled to the inverting input end of the second comparator and the first end of the second resistor, and is configured to output the second threshold voltage to the inverting input end of the second comparator; a first end of the fifth resistor is coupled to a reference voltage terminal, and a second end of the fifth resistor is coupled to the output end of the first comparator; and both the output end of the first comparator and the output end of the second comparator are coupled to the output control circuit by the sixth resistor, and are configured to output the switch control signals.

3. The signal protection circuit according to claim 1, wherein the output control circuit is configured to connect the input signal end with the output signal end by the voltage division circuit in response to the first-level switch control signal; and connect the input signal end with the ground terminal by the voltage division circuit in response to the second-level switch control signal.

4. The signal protection circuit according to claim 3, wherein the voltage division circuit comprises a seventh resistor and an eighth resistor; a first end of the seventh resistor is coupled to the input signal end, and a second end of the seventh resistor is separately coupled to a first end of the eighth resistor and the signal control circuit, and is configured to output the divided voltage; and a second end of the eighth resistor is coupled to the output control circuit.

5. The signal protection circuit according to claim 3, wherein the output control circuit comprises a two-channel selection switch; and a control end of the two-channel selection switch is coupled to the signal control circuit, and is configured to receive the switch control signals, an input end of the two-channel selection switch is coupled to the voltage division circuit, a first output end of the two-channel selection switch is coupled to the output signal end, and a second output end of the two-channel selection switch is coupled to the ground terminal.

6. The signal protection circuit according to claim 5, wherein the output control circuit further comprises: a ninth resistor, a tenth resistor, and a switch transistor, wherein the second output end of the two-channel selection switch is coupled to the ground terminal by the ninth resistor, the tenth resistor, and the switch transistor; a first end of the ninth resistor is coupled to the second output end of the two-channel selection switch, and a second end of the ninth resistor is coupled to a first pole of the switch transistor; a gate of the switch transistor is coupled to the signal control circuit, and is configured to receive the switch control signals, and a second pole of the switch transistor is coupled to a first end of the tenth resistor; and a second end of the tenth resistor is coupled to the ground terminal.

7. A signal processing chip, comprising: a chip main circuit having at least one output end and at least one signal protection circuit according to claim 1, wherein one signal protection circuit and one output end of the chip main circuit are correspondingly disposed; and an input signal end of the signal protection circuit is coupled to a corresponding output end of the chip main circuit, and an output signal end of the signal protection circuit is used as a new output end of corresponding chip main circuit.

8. The signal processing chip according to claim 7, wherein the signal processing chip comprises a level conversion chip.

9. The signal processing chip according to claim 7, wherein output ends of the chip main circuit are disposed with signal protection circuits in one-to-one manner.

10. A display panel, comprising the signal protection circuit according to claim 1.

11. The display panel according to claim 10, wherein the display panel comprises: a gate driving circuit; a plurality of cables, configured to input signals to the gate driving circuit; a plurality of signal input terminals, wherein one signal input terminal is correspondingly coupled to one cable; at least one signal protection circuit, wherein one signal protection circuit corresponds to one signal input terminal; and an input signal end of the signal protection circuit is coupled to corresponding signal input terminal, and an output signal end of the signal protection circuit is coupled to corresponding cable.

12. The display panel according to claim 11, wherein the signal input terminals are correspondingly disposed with the signal protection circuits in one-to-one manner.

13. An electronic device, comprising the signal processing chip according to claim 7.

14. A driving method of the signal protection circuit according to claim 1, comprising: dividing, by the voltage division circuit, a voltage of an input signal end and outputting a divided voltage; outputting, by the signal control circuit, a first-level switch control signal when the divided voltage is greater than a first threshold voltage and the divided voltage is less than a second threshold voltage; and connecting, by the output control circuit the input signal end with an output signal end in response to the first-level switch control signal; and outputting, by the signal control circuit, a second-level switch control signal when the divided voltage is less than the first threshold voltage or the divided voltage is greater than the second threshold voltage; and connecting, by the output control circuit, the input signal end with a ground terminal in response to the second-level switch control signal.

15. The display panel according to claim 10, wherein the signal control circuit comprises: a first resistor, a second resistor, a first comparator, and a second comparator; an inverting input end of the first comparator is configured to receive the divided voltage, a non-inverting input end of the first comparator is configured to receive the first threshold voltage, and an output end of the first comparator is coupled to the output control circuit, and is configured to output switch control signals; a non-inverting input end of the second comparator is configured to receive the divided voltage, an inverting input end of the second comparator is configured to receive the second threshold voltage, and an output end of the second comparator is coupled to the output control circuit, and is configured to output the switch control signals; a first end of the first resistor is coupled to the non-inverting input end of the first comparator, and a second end of the first resistor is coupled to the ground terminal; and a first end of the second resistor is coupled to the inverting input end of the second comparator, and a second end of the second resistor is coupled to the ground terminal.

16. The display panel according to claim 15, wherein the signal control circuit further comprises: a first current source, a second current source, a third resistor, a fourth resistor, a fifth resistor, and a sixth resistor; a current output end of the first current source is coupled to a first end of the third resistor, and a second end of the third resistor is coupled to the non-inverting input end of the first comparator and the first end of the first resistor, and is configured to output the first threshold voltage to the non-inverting input end of the first comparator; a current output end of the second current source is coupled to a first end of the fourth resistor, and a second end of the fourth resistor is coupled to the inverting input end of the second comparator and the first end of the second resistor, and is configured to output the second threshold voltage to the inverting input end of the second comparator; a first end of the fifth resistor is coupled to a reference voltage terminal, and a second end of the fifth resistor is coupled to the output end of the first comparator; and both the output end of the first comparator and the output end of the second comparator are coupled to the output control circuit by the sixth resistor, and are configured to output the switch control signals.

17. The display panel according to claim 10, wherein the output control circuit is configured to connect the input signal end with the output signal end by the voltage division circuit in response to the first-level switch control signal; and connect the input signal end with the ground terminal by the voltage division circuit in response to the second-level switch control signal.

18. The display panel according to claim 17, wherein the voltage division circuit comprises a seventh resistor and an eighth resistor; a first end of the seventh resistor is coupled to the input signal end, and a second end of the seventh resistor is separately coupled to a first end of the eighth resistor and the signal control circuit, and is configured to output the divided voltage; and a second end of the eighth resistor is coupled to the output control circuit.

19. The display panel according to claim 17, wherein the output control circuit comprises a two-channel selection switch; and a control end of the two-channel selection switch is coupled to the signal control circuit, and is configured to receive the switch control signals, an input end of the two-channel selection switch is coupled to the voltage division circuit, a first output end of the two-channel selection switch is coupled to the output signal end, and a second output end of the two-channel selection switch is coupled to the ground terminal.

* * * * *